US010914039B2

(12) United States Patent
Shannon et al.

(10) Patent No.: US 10,914,039 B2
(45) **Date of Patent: *Feb. 9, 2021**

(54) SOFT TISSUE COMPRISING NON-WOOD FIBERS

(71) Applicant: Kimberly-Clark Worldwide, Inc., Neenah, WI (US)

(72) Inventors: Thomas Gerard Shannon, Neenah, WI (US); Richard Louis Underhill, Neenah, WI (US); Kevin Leon LaBerge, Sherwood, WI (US); John Matthew Reiser, Snellville, GA (US); Gilbert Darrell Gafford, Cumming, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/699,918

(22) Filed: Dec. 2, 2019

(65) Prior Publication Data

US 2020/0115853 A1 Apr. 16, 2020

Related U.S. Application Data

(63) Continuation of application No. 16/173,425, filed on Oct. 29, 2018, now Pat. No. 10,550,522, and a continuation of application No. 15/574,321, filed on Nov. 15, 2017, now Pat. No. 10,145,069, said application No. 16/173,425 is a continuation of application No. 15/574,321, filed as application No. PCT/US2015/033168 on May 29, 2015, now Pat. No. 10,145,069.

(51) Int. Cl.

| | |
|---|---|
| ***D21H 27/00*** | (2006.01) |
| ***D21H 27/30*** | (2006.01) |
| ***D21H 11/02*** | (2006.01) |
| ***D21H 11/08*** | (2006.01) |
| ***D21H 11/12*** | (2006.01) |
| ***D21H 27/38*** | (2006.01) |
| ***D21H 11/10*** | (2006.01) |

(52) U.S. Cl.

CPC ..... *D21H 27/007* (2013.01); *D21H 11/02* (2013.01); *D21H 11/08* (2013.01); *D21H 11/12* (2013.01); *D21H 27/002* (2013.01); *D21H 27/30* (2013.01); *D21H 11/10* (2013.01); *D21H 27/004* (2013.01); *D21H 27/38* (2013.01)

(58) Field of Classification Search

CPC .... D21H 27/002; D21H 27/30; D21H 25/005; D21H 27/005; D21H 27/38; D21H 27/007; D21H 11/12; D21H 11/10; D21H 11/02; D21H 11/08

See application file for complete search history.

(56) References Cited

U.S. PATENT DOCUMENTS

| | | | | |
|---|---|---|---|---|
| 4,300,981 | A | 11/1981 | Carstens | |
| 5,320,710 | A | 6/1994 | Reeves et al. | |
| 6,258,207 | B1 | 7/2001 | Pan | |
| 6,302,997 | B1 | 10/2001 | Hurter et al. | |
| 6,455,129 | B1 | 9/2002 | Kershaw et al. | |
| 6,511,579 | B1 | 1/2003 | Edwards et al. | |
| 7,682,488 | B2 | 3/2010 | Yeh et al. | |
| 8,049,060 | B2 | 11/2011 | Vinson et al. | |
| 8,741,104 | B2 | 6/2014 | Edwards et al. | |
| 10,132,036 | B2 * | 11/2018 | Collins | D21H 11/12 |
| 10,145,066 | B2 * | 12/2018 | Shannon | D21H 27/002 |
| 10,145,069 | B2 * | 12/2018 | Shannon | D21H 11/02 |
| 10,337,147 | B2 * | 7/2019 | Rouse | D21H 27/002 |
| 10,337,148 | B2 * | 7/2019 | Rouse | D21H 27/002 |
| 10,337,149 | B2 * | 7/2019 | Rouse | D21H 27/42 |
| 10,519,601 | B2 * | 12/2019 | Shannon | D21H 11/12 |
| 10,526,752 | B2 * | 1/2020 | Rouse | D21H 27/005 |
| 10,550,522 | B2 * | 2/2020 | Shannon | D21H 11/08 |
| 2002/0148584 | A1 | 10/2002 | Edwards et al. | |
| 2003/0192662 | A1 | 10/2003 | Heath et al. | |
| 2004/0140076 | A1 | 7/2004 | Hermans et al. | |
| 2004/0168780 | A1 | 9/2004 | Dwiggins et al. | |

(Continued)

FOREIGN PATENT DOCUMENTS

| | | |
|---|---|---|
| EP | 2513372 B1 | 3/2014 |
| GB | 1374198 A | 11/1974 |

(Continued)

OTHER PUBLICATIONS

Deniz et al. in "Kraft and Modified Kraft Pulping of Bamboo (Phyllostachys Bambusoides)," Drewno 2017, vol. 60, No. 200.

(Continued)

*Primary Examiner* — Jose A Fortuna

(74) *Attorney, Agent, or Firm* — Kimberly-Clark Worldwide, Inc.

(57) ABSTRACT

The present invention provides soft, durable and bulky tissue products comprising non-wood fibers and more particularly hesperaloe fiber. The inventors have discovered that high yield hesperaloe pulp fiber, when incorporated in amounts of at least about 5 percent by weight of the tissue product, produces products having a GMT less than about 1000 g/3" and a GM Slope less than about 7.0 kg. At the foregoing tensile strengths and modulus the tissue products of the present invention are also generally soft, such as having a Stiffness Index less than about 10.0, and more preferably less than about 9.0, such as from about 7.0 to about 9.0.

15 Claims, No Drawings

(56) References Cited

U.S. PATENT DOCUMENTS

| | | | | |
|---|---|---|---|---|
| 2004/0226673 | A1 | 11/2004 | Edwards et al. | |
| 2005/0236122 | A1 | 10/2005 | Mullally et al. | |
| 2007/0051484 | A1 | 3/2007 | Hermans et al. | |
| 2007/0107863 | A1 | 5/2007 | Edwards et al. | |
| 2008/0008853 | A1 | 1/2008 | Hupp et al. | |
| 2010/0126685 | A1 | 5/2010 | Fike et al. | |
| 2013/0068867 | A1 | 3/2013 | Hermans et al. | |
| 2013/0068868 | A1 | 3/2013 | Hermans et al. | |
| 2013/0071678 | A1 | 3/2013 | Shannon | |
| 2013/0199741 | A1 | 8/2013 | Stage et al. | |
| 2013/0269892 | A1 | 10/2013 | Hermans et al. | |
| 2014/0093704 | A1 | 4/2014 | Shi et al. | |
| 2014/0093705 | A1 | 4/2014 | Shi et al. | |
| 2014/0205777 | A1 | 7/2014 | Hawkins et al. | |
| 2014/0284010 | A1 | 9/2014 | Shannon | |
| 2015/0129143 | A1 | 5/2015 | Hawkins et al. | |
| 2018/0044859 | A1 | 2/2018 | Hermans et al. | |
| 2018/0135248 | A1 | 5/2018 | Collins et al. | |
| 2018/0135249 | A1 | 5/2018 | Shannon et al. | |
| 2018/0135253 | A1* | 5/2018 | Shannon | D21H 11/02 |
| 2018/0142419 | A1 | 5/2018 | Rouse et al. | |
| 2018/0142420 | A1 | 5/2018 | Rouse et al. | |
| 2018/0142421 | A1 | 5/2018 | Rouse et al. | |
| 2019/0100878 | A1* | 4/2019 | Shannon | D21H 27/002 |
| 2019/0100883 | A1* | 4/2019 | Shannon | D21H 27/005 |
| 2019/0264395 | A1* | 8/2019 | Rouse | D21H 27/005 |
| 2020/0102705 | A1* | 4/2020 | Rouse | D21G 1/00 |
| 2020/0115853 | A1* | 4/2020 | Shannon | D21H 27/30 |
| 2020/0232166 | A1* | 7/2020 | Rouse | D21H 27/38 |

FOREIGN PATENT DOCUMENTS

| | | | | |
|---|---|---|---|---|
| MX | 2010001159 | A | 7/2011 | |
| WO | 2016195625 | A1 | 12/2016 | |
| WO | 2016195627 | A1 | 12/2016 | |
| WO | 2016195629 | A1 | 12/2016 | |
| WO | WO-2016195625 | A1 * | 12/2016 | D21H 27/30 |
| WO | WO-2016195627 | A1 * | 12/2016 | D21H 27/005 |

OTHER PUBLICATIONS

Economic Research Services: "Natural Fibers Hesperaloe Has Properties That Interest Papermakers", Sep. 1, 1996 (Sep. 1, 1996), XP055526919, Retrieved from the Internet: URL: https://www.ers.usda.gov/webdocs/publications/37342/32911_ius6d_002.pdf?v=41471 [retrieved on Nov. 26, 2018].

Eugenio et al., in "Evaluation of Hesperaloe funifera pulps obtained by a low energy consumption process as a reinforcement material in recycled pulps," Forest Systems 21(3) pp. 460-467. (Year: 2012).

Hurter, Robert W., in "Nonwood Plant Fiber Characteristics" HurterConsult pp. 1-4 (Year. 2001).

McLaughlin, Steven in "Properties of Paper Made From Fibers of Hesperaloe Funifera (*Agavaceae*)," Economic Botany, 54(2) pp. 192-196. (Year: 2000).

Protasio et al. in "Brazilian Lignocellulosic Wastes for Bioenergy Production: Characterization and Comparison with Fossil Fuels," BioResources 8(1), 1166-1185 (Year 2013).

* cited by examiner

SOFT TISSUE COMPRISING NON-WOOD FIBERS

RELATED APPLICATIONS

The present application is a continuation application and claims priority to U.S. patent application Ser. No. 16/173,425, filed on Oct. 29, 2019, which is a continuation application and claims priority to U.S. patent application Ser. No. 15/574,321, filed on Nov. 15, 2017, now U.S. Pat. No. 10,145,069, which is a national-phase entry, under 35 U.S.C. § 371, of PCT Patent Application No. PCT/US15/33168, filed on May 29, 2015, all of which are incorporated herein by reference.

BACKGROUND OF THE DISCLOSURE

Tissue products, such as facial tissues, paper towels, bath tissues, napkins, and other similar products, are designed to include several important properties. For example, the products should have good bulk, a soft feel, and should have good strength and durability. Unfortunately, however, when steps are taken to increase one property of the product, other characteristics of the product are often adversely affected.

To achieve the optimum product properties, tissue products are typically formed, at least in part, from pulps containing wood fibers and often a blend of hardwood and softwood fibers to achieve the desired properties. Typically when attempting to optimize surface softness, as is often the case with tissue products, the papermaker will select the fiber furnish based in part on the coarseness of pulp fibers. Pulps having fibers with low coarseness are desirable because tissue paper made from fibers having a low coarseness can be made softer than similar tissue paper made from fibers having a high coarseness. To optimize surface softness even further, premium tissue products usually comprise layered structures where the low coarseness fibers are directed to the outside layer of the tissue sheet with the inner layer of the sheet comprising longer, coarser fibers.

Unfortunately, the need for softness is balanced by the need for durability. Durability in tissue products can be defined in terms of tensile strength, tensile energy absorption (TEA), burst strength and tear strength. Typically tear, burst and TEA will show a positive correlation with tensile strength while tensile strength, and thus durability, and softness are inversely related. Thus the paper maker is continuously challenged with the need to balance the need for softness with a need for durability. Unfortunately, tissue paper durability generally decreases as the fiber length is reduced. Therefore, simply reducing the pulp fiber length can result in an undesirable trade-off between product surface softness and product durability.

Besides durability long fibers also play an important role in overall tissue product softness. While surface softness in tissue products is an important attribute, a second element in the overall softness of a tissue sheet is stiffness. Stiffness can be measured from the tensile slope of stress-strain tensile curve. The lower the slope the lower the stiffness and the better overall softness the product will display. Stiffness and tensile strength are positively correlated, however at a given tensile strength shorter fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low coarseness long fibers, such as those provided by northern softwood kraft (NSWK) fibers typically supply the best combination of durability and softness in tissue products when those fibers are used in combination with hardwood Kraft fibers such as Eucalyptus hardwood Kraft fibers. While Northern Softwood Kraft Fibers have a higher coarseness than Eucalyptus fibers their small cell wall thickness relative to lumen diameter combined with their long length makes them the ideal candidate for optimizing durability and softness in tissue.

Unfortunately supply of NSWK is under significant pressure both economically and environmentally. As such, prices of NSWK have escalated significantly creating a need to find alternatives to optimize softness and strength in tissue products. Alternatives, however, are limited. For example, southern softwood kraft (SSWK) may only be used in limited amounts in the manufacture of tissue products because its high coarseness results in stiffer, harsher feeling products than NSWK. Thus, there remains a need for an alternative to NSWK for the manufacture of premium tissue products, which must be both soft and strong.

SUMMARY OF THE DISCLOSURE

The present inventors have successfully used hesperaloe fibers to produce a tissue having satisfactory softness, strength and bulk. To produce the instant tissue products the inventors have successfully moderated the changes in strength and stiffness typically associated with substituting conventional wood papermaking fibers, such as NSWK, with hesperaloe fibers. Not only have the inventors succeeded in moderating changes to strength and stiffness they have done so without negatively effecting bulk. As such, the tissue products of the present invention have properties comparable to or better than those produced using conventional wood papermaking fibers, and more particularly softwood fibers, and still more particularly NSWK fibers. Accordingly, in certain preferred embodiments, the invention provides tissue products in which hesperaloe fibers replace at least about 50 percent of the NSWK, more preferably at least about 75 percent and still more preferably all NSWK without negatively effecting the tissue products strength, stiffness and bulk.

In other embodiments the present invention provides tissue products comprising a multi-layered tissue web where one or more of the layers comprise a blend of hesperaloe fibers and NSWK fibers and/or Southern Softwood Kraft (SSWK) fibers. Blending hesperaloe fibers with NSWK fibers and/or SSWK fibers may improve the physical properties of the tissue product, such as increased softness and durability while reducing the cost of manufacture. In particularly preferred embodiments the multi-layered tissue structure comprises two outer layers and a middle layer, where the outer layers are substantially free from hesperaloe fiber and the middle layer consists essentially of hesperaloe fiber.

In yet other embodiments the present invention provides a tissue product comprising from about 20 to about 50 weight percent hesperaloe fiber and substantially free from long average fiber length kraft fibers, such as NSWK and SSWK, the tissue product having a sheet bulk greater than about 10 cc/g, a GMT from about 500 to about 750 g/3", a Stiffness Index less than about 8.0 and a Durability Index greater than about 30.

In still other embodiments the present invention provides a tissue product comprising at least about 20 weight percent hesperaloe fiber, the tissue product having a GMT from about 400 to about 1,000 g/3", a Stiffness Index less than about 10 and more preferably less than about 8.0, and a sheet bulk greater than about 10 cc/g.

In another embodiment the present invention provides a tissue product comprising at least one through-air dried tissue web, the web comprising at least about 20 weight percent hesperaloe fiber, the tissue product having a GMT from about 500 to about 750 g/3", a Stiffness Index less than about 8.0 and a Durability Index greater than about 30.

In yet another embodiment the present invention provides a tissue product comprising from about 20 to about 50 weight percent hesperaloe fiber, the tissue product having a sheet bulk greater than about 10 cc/g, a GMT from about 500 to about 750 g/3", a Stiffness Index less than about 8.0 and a Durability Index greater than about 30.

In other embodiments the present invention provides a tissue product comprising from about 20 to about 50 weight percent hesperaloe fiber and substantially free from NSWK, the tissue product having a basis weight from about 20 to about 50 gsm, a GMT from about 500 to about 750 g/3", a Stiffness Index less than about 8.0 and a Durability Index greater than about 32.

In still other embodiments the present invention provides a product comprising at least one multi-layered through-air dried tissue web comprising a first and a second layer, the first layer being substantially free from high yield hesperaloe pulp fibers and the second layer consisting essentially of high yield hesperaloe pulp fibers, the tissue product having a Durability Index greater than about 28.0 and a Stiffness Index less than about 10.0, wherein the tissue product comprises from about 20 to about 50 weight percent high yield hesperaloe pulp fibers.

In yet other embodiments the present invention provides a single-ply through-air dried tissue product comprising at least about 20 weight percent high yield hesperaloe pulp fibers, the tissue product having a basis weight from about 30 to about 60 gsm, a sheet bulk greater than about 10 cc/g and a Stiffness Index less than about 10.

Definitions

As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "Burst Index" refers to the dry burst peak load (typically having units of grams) at a relative geometric mean tensile strength (typically having units of grams per three inches) as defined by the equation:

$$\text{Burst Index} = \frac{\text{Dry Burst Peak Load (g)}}{GMT\ (\text{g}/3'')} \times 10$$

While Burst Index may vary tissue products prepared according to the present disclosure generally have a Burst Index greater than about 8.0, more preferably greater than about 8.5 and still more preferably greater than about 9.0.

As used herein, the term "TEA Index" refers the geometric mean tensile energy absorption (typically expressed in $g \cdot cm/cm^2$) at a given geometric mean tensile strength (typically having units of grams per three inches) as defined by the equation:

$$TEA\ \text{Index} = \frac{GM\ TEA(\text{g} \cdot \text{cm/cm2})}{GMT\ (\text{g}/3'')} \times 1{,}000$$

While the TEA Index may vary tissue products prepared according to the present disclosure generally have a TEA Index greater than about 9.0, more preferably greater than about 9.5 and still more preferably greater than about 10.0.

As used herein, the term "Tear Index" refers to the GM Tear Strength (typically expressed in grams) at a relative geometric mean tensile strength (typically having units of grams per three inches) as defined by the equation:

$$\text{Tear Index} = \frac{GM\ \text{Tear (g)}}{GMT\ (\text{g}/3'')} \times 1{,}000$$

While the Tear Index may vary tissue products prepared according to the present disclosure generally have a Tear Index greater than about 12.0, more preferably greater than about 12.5 and still more preferably greater than about 13.0.

As used herein, the term "Durability Index" refers to the sum of the Tear Index, the Burst Index, and the TEA Index and is an indication of the durability of the product at a given tensile strength.

$$\text{Durability Index} = \text{Tear Index} + \text{Burst Index} + \text{TEA Index}$$

While the Durability Index may vary tissue products prepared according to the present disclosure generally have a Durability Index value greater than about 28, more preferably greater than about 30 and still more preferably greater than about 32.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g). Tissue products prepared according to the present invention generally have a sheet bulk greater than about 10 cc/g, more preferably greater than about 11 cc/g and still more preferably greater than about 12 cc/g.

As used herein, the term "fiber length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k}(x_i \times n_i)/n$$

where k=maximum fiber length
$x_i$=fiber length
$n_i$=number of fibers having length $x_i$
n=total number of fibers measured.

As used herein, the term "hesperaloe fiber" refers to a fiber derived from a plant of the genus *Hesperaloe* of the family Asparagaceae including, for example, *Hesperaloe funifera*. The fibers are generally processed into a pulp for use in the manufacture of tissue products according to the present invention. Preferably the pulping process is a high yield pulping process. The high yield hesperaloe pulp fibers generally have a lignin content, measured as Klason lignin, from about 10 to about 15 weight percent. The terms "hesperaloe fiber" and "high yield hesperaloe pulp fiber" may be used interchangeably herein when referring to non-wood fibers incorporated into tissue products, one skilled in the art will appreciate however that when incorporating non-wood fibers into tissue products it is preferred that the fibers be processed, such as by high yield pulping.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope. GM Slop generally is expressed in units of kg.

As used herein, the terms "geometric mean tensile" and "GMT" refer to the square root of the product of the machine direction tensile strength and the cross-machine direction tensile strength of the web. While the GMT may vary tissue products prepared according to the present disclosure generally have a GMT greater than about 400 g/3", more preferably greater than about 500 g/3" and still more preferably greater than about 600 g/3".

As used herein, the term "Stiffness Index" refers to the quotient of the geometric mean tensile slope, defined as the square root of the product of the MD and CD slopes (typically having units of kg), divided by the geometric mean tensile strength (typically having units of grams per three inches).

$$\text{Stiffness Index} = \frac{\sqrt{MD\ \text{Tensile Slope (kg)} \times CD\ \text{Tensile Slope (kg)}}}{GMT\ (\text{g}/3'')} \times 1{,}000$$

While the Stiffness Index may vary tissue products prepared according to the present disclosure generally have a Stiffness Index less than about 10.0, more preferably less than about 9.0 and still more preferably less than about 8.0.

DETAILED DESCRIPTION OF THE DISCLOSURE

Generally the skilled tissue maker is concerned with balancing various tissue properties such as bulk, softness, stiffness and strength. For example, the tissue maker often desires to increase bulk without stiffening the tissue product or reducing softness, while at the same time maintaining a given tensile strength. Previous attempts to manufacture tissue using hesperaloe fibers have not successfully balanced these important tissue properties resulting in reduced bulk with dramatic increases in tensile and stiffness. Despite the failings of the prior art, the present inventors have now succeeded in moderating the changes in strength and stiffness without negatively effecting bulk when manufacturing a tissue product comprising hesperaloe fibers, as illustrated in Table 1, below.

TABLE 1

| Example | Furnish | Delta Bulk | Delta GMT | Delta GM Slope |
|---|---|---|---|---|
| U.S. Pat. No. 5,320,710 | 50% *H. Funifera* 50% NSWK | −20% | 192% | 65% |
| Inventive | 40% *H. Funifera* 60% EHWK | 2% | 1% | 8% |

Not only were previous attempts to balance bulk, strength, stiffness and softness unsuccessful, the resulting tissue products were not suitable for use as premium bath tissue because the strengths and modulus were excessively high. For example, when compared to Northern® Bathroom Tissue the inventive code of U.S. Pat. No. 5,320,710 had 11 percent lower bulk, 23 percent greater modulus and 148 percent greater stiffness (measured as the modulus divided by the tensile strength). The present inventors have overcome these failings to provide a tissue product that is comparable or better than commercially available bath tissue products. For example, when compared to a current version of Northern® Bathroom Tissue, products of the present invention have comparable bulks, 31 percent lower modulus and 13 percent lower stiffness.

Without being bound by any particular theory, the high degree of strength and stiffness observed previously in tissue products may be attributed in-part to the morphology of hesperaloe fiber when prepared by chemical pulping, which has a relatively long fiber length, high aspect ratio and high ratio of fiber length to cell wall thickness. A comparison of fiber morphology, as reported in the literature for, hesperaloe kraft pulp fibers, conventional NSWK and SSWK is provided in Table 2, below.

TABLE 2

| Fiber | Fiber Length (mm) | Average Fiber Width (μm) | Cell Wall Thickness (μm) | Aspect Ratio | Fiber Length:Cell Wall Thickness |
|---|---|---|---|---|---|
| *H. Funifera* kraft pulp | 3.4 | 16.5 | 3.5 | 206 | 971 |
| NSWK | 3.5 | 36 | 6 | 97 | 583 |
| SSWK | 4.0 | 43 | 7 | 93 | 571 |

Despite the foregoing properties of hesperaloe kraft pulp fibers and the tendency of such pulps to produce overly strong and stiff tissue products, the present inventors have discovered that hesperaloe fibers processed by high yield pulping means, such as mechanical pulping, may be a suitable replacement for high fiber length wood fibers without decreasing bulk, significantly altering tensile, increasing stiffness or reducing softness. Processing of hesperaloe fibers by high yield pulping means generally yields a fiber having a slightly shorter fiber length and higher coarseness compared to hesperaloe chemical pulp fibers.

Not only have the present inventors discovered that high yield hesperaloe pulp fibers are a suitable replacement for high fiber length wood fibers, such as NSWK, but also that the resulting tissue products have physical properties comparable to or better than those produced using NSWK fibers. Accordingly, in certain embodiments, hesperaloe fibers may replace at least about 50 percent of the NSWK in the tissue product, more preferably at least about 75 percent and still more preferably all NSWK without negatively effecting the tissue products softness and durability.

Thus, in one embodiment the present invention provides a tissue product comprising at least about 5 percent, by weight of the tissue product, high yield hesperaloe pulp fiber, the tissue product having a GMT less than about 1000 g/3" and a GM Slope less than about 7.0 kg. In still other embodiments the present disclosure provides a tissue product having a GMT from about 400 to about 1,000 g/3" and more preferably from about 500 to about 800 g/3", a GM Slope less than about 7.0 kg, such as from about 4.5 to about 7.0 kg, and comprising from about 5 to about 50 percent, by weight of the tissue product, high yield hesperaloe pulp fiber. At the foregoing tensile strengths and modulus the tissue products of the present invention are also generally soft, such as having a Stiffness Index less than about 10.0, and more preferably less than about 9.0, such as from about 7.0 to about 9.0.

The improved properties are further illustrated in the table below which compares the change in various tissue product properties relative to comparable tissue products comprising NSWK. All tissues shown in Table 3 are single-ply products having a basis weight of about 35 grams per square meter (gsm) and comprising either 40 weight percent NSWK or hesperaloe and 60 weight percent EHWK, based upon the total weight of the tissue product. Surprisingly hesperaloe provides comparable levels of durability without stiffening or dramatically increasing tensile strength.

TABLE 3

| | NSWK | High Yield Hesperaloe Fiber | Delta (%) |
|---|---|---|---|
| GMT (g/3") | 627 | 635 | 1.3 |
| Sheet Bulk (cc/g) | 11 | 11.2 | 1.8 |
| Tear Index | 14.04 | 14.96 | 6.6 |
| TEA Index | 9.09 | 9.45 | 4.0 |
| Burst Index | 9.38 | 8.27 | −11.8 |
| Durability Index | 32.5 | 32.7 | 0.6 |
| Stiffness Index | 7.66 | 8.2 | 6.9 |

Accordingly, in certain embodiments the present invention provides tissue products that are not only soft, but also highly durable at relatively modest tensile strengths. As such the tissue products generally have a GMT less than about 1000 g/3", such as from about 400 to about 1,000 g/3", and more preferably from about 500 to about 800 g/3", but still have a Durability Index greater than about 25, such as from about 25 to about 35, and more preferably from about 30 to about 35.

In other embodiments the tissue products have a Stiffness Index less than about 10.0 and a Durability Index greater than about 30, such as from about 30 to about 35. In one particularly preferred embodiment the tissue product comprises a through-air dried web comprising less than about 5 weight percent NSWK, and from about 10 to about 40 weight percent hesperaloe fiber, the tissue product a Durability Index from about 30 to about 35 and Stiffness Index from about 8.0 to about 10.0.

In a particularly preferred embodiment the tissue product comprises a multi-layered through-air dried web wherein hesperaloe fiber is selectively disposed in only one of the layers such that the hesperaloe fiber is not brought into contact with the user's skin in-use. For example, in one embodiment the tissue web may comprise a two layered web wherein the first layer consists essentially of hardwood kraft pulp fibers and is substantially free of hesperaloe and the second layer comprises hesperaloe, wherein the hesperaloe comprises at least about 50 percent by weight of the second layer, such as from about 50 to about 100 percent by weight of the second layer. It should be understood that, when referring to a layer that is substantially free of hesperaloe fibers, negligible amounts of the fiber may be present therein, however, such small amounts often arise from the hesperaloe fibers applied to an adjacent layer, and do not typically substantially affect the softness or other physical characteristics of the web.

The tissue webs may be incorporated into tissue products that may be either single- or multi-ply, where one or more of the plies may be formed by a multi-layered tissue web having hesperaloe fibers selectively incorporated in one of its layers. In one embodiment the tissue product is constructed such that the hesperaloe fibers are not brought into contact with the user's skin in-use. For example, the tissue product may comprise two multi-layered through-air dried webs wherein each web comprises a first fibrous layer substantially free from hesperaloe fibers and a second fibrous layer comprising hesperaloe fibers. The webs are plied together such that the outer surface of the tissue product is formed from the first fibrous layer of each web and the second fibrous layer comprising the hesperaloe fibers is not brought into contact with the user's skin in-use.

Generally hesperaloe fibers useful in the present invention are derived from non-woody plants in the genus *Hesperaloe* in the family Agavaceae. Suitable species within the genus

*Hesperaloe* include, for example *H. funifera, H. nocturne, H. parviflova*, and *H. changii*, as well as combinations thereof.

In certain embodiments the hesperaloe fibers are processed by a high yield pulping process, such as mechanically treating the fibers. High yield pulping processes include, for example, mechanical pulp (MP), refiner mechanical pulp (RMP), pressurized refiner mechanical pulp (PRMP), thermomechanical pulp (TMP), high temperature TMP (HT-TMP) RTS-TMP, thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW) or any modifications and combinations thereof. Processing of hesperaloe fibers using a high yield pulping process generally results in a pulp having a yield of at least about 85 percent, more preferably at least about 90 percent and still more preferably at least about 95 percent.

The high yield pulping process may comprise heating the hesperaloe fiber above ambient temperatures, such as from about to 100 to about 200° C. and more preferably from about 120 to about 190° C. while subjecting the fiber to mechanical forces. In other embodiments a caustic or oxidizing agent may be introduced to the process to facilitate fiber separation. For example, in one embodiment a 3-8 percent solution of NaOH may be added to the fiber during mechanical treatment. Although a caustic or oxidizing agent may be added during processing, it is generally preferred that the hesperaloe fiber is not pretreated with a chemical agent prior to processing. For example, high yield hesperaloe pulps are generally prepared without pretreatment of the fiber with an aqueous solution of sodium sulfite or the like, which is commonly employed in the manufacture of chemi-mechanical wood pulps.

Generally the high yield pulping process removes from about 1 to about 3 weight percent of the lignin from the hesperaloe fiber. As such high yield hesperaloe pulp useful in the present invention generally has a lignin content less than about 15 weight percent, preferably less than about 13 weight percent and still more preferably less than about 11 weight percent, such as from about 10 to about 15 weight percent.

In a particularly preferred embodiment hesperaloe fibers are utilized in the tissue web as a replacement for high fiber length wood fibers such as softwood fibers and more specifically NSWK or Southern softwood kraft (SSWK). In one particular embodiment the hesperaloe fibers are substituted for NSWK such that the total amount of NSWK, by weight of the tissue product, is less than about 10 percent and more preferably less than about 5 percent. In other embodiments it may be desirable to replace all of the NSWK with hesperaloe fibers such that the tissue product is substantially free from NSWK. In other embodiments hesperaloe fibers may be blended with SSWK fibers such that the total amount of SSWK, by weight of the tissue product, is less than about 10 percent and more preferably less than about 5 percent.

If desired, various chemical compositions may be applied to one or more layers of the multi-layered tissue web to further enhance softness and/or reduce the generation of lint or slough. For example, in some embodiments, a wet strength agent can be utilized, to further increase the strength of the tissue product. As used herein, a "wet strength agent" is any material that, when added to pulp fibers can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts, depending on the desired characteristics of the web. For instance, in some embodiments, the total amount of wet strength agents added can be between about 1 to about 60 pounds per ton (lbs/T), in some embodiments, between about 5 to about 30 lbs/T, and in some embodiments, between about 7 to about 13 lbs/T of the dry weight of fibrous material. The wet strength agents can be incorporated into any layer of the multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lbs/T, in some embodiments between about 3 to about 20 lbs/T, and in some embodiments, between about 6 to about 15 lbs/T of the dry weight of fibrous material. The debonder can be incorporated into any layer of the multi-layered tissue web.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

Still other suitable debonders are disclosed in U.S. Pat. Nos. 5,529,665 and 5,558,873, both of which are incorporated herein in a manner consistent with the present disclosure. In particular, U.S. Pat. No. 5,529,665 discloses the use of various cationic silicone compositions as softening agents.

Tissue webs useful in forming tissue products of the present invention can generally be formed by any of a variety of papermaking processes known in the art. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Examples of papermaking processes and techniques useful in forming tissue webs according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is formed by through-air drying and be either creped or uncreped. When forming multi-ply tissue products, the separate plies can be made from the same process or from different processes as desired.

Test Methods

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods 1402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006") in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the proscribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single-ply basesheet. This is done by multiplying the single-ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3 inches±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a two ply product was tested as two plies and the tensile recorded as such. Alternatively, a single ply may be tested and the result multiplied by the number of plies in the final product to get the tensile strength.

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings has an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TAPPI conditions and cut into 127×127 mm±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises three sheets of product. For example, if the product is a 2-ply tissue product, three sheets of product, totaling six plies are tested. If the product is a single-ply tissue product, then three sheets of product totaling three plies are tested.

Prior to testing the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is <450 gf a 10 Newton load cell is used, if peak load is >450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the Dry Burst Strength.

EXAMPLES

Example 1

Single-ply uncreped through-air dried (UCTAD) tissue web were made generally in accordance with U.S. Pat. No. 5,607,551. The tissue webs and resulting tissue products were formed from various fiber furnishes including, Eucalyptus Hardwood Kraft (EHWK) pulp, NSWK pulp, and high yield hesperaloe pulp (HYH).

The EHWK furnish was prepared by dispersing about 120 pounds (oven dry basis) EHWK pulp in a pulper for 30 minutes at a consistency of about 3 percent. The fiber was then transferred to a machine chest and diluted to a consistency of 1 percent. In certain instances starch (Redibond 2038 A) was added to the EHWK machine chest as indicated in Table 4.

The NSWK furnish was prepared by dispersing about 50 pounds (oven dry basis) of NSWK pulp in a pulper for 30 minutes at a consistency of about 3 percent. The fiber was then transferred to a machine chest and diluted to a consistency of 1 percent. In certain instances starch (Redibond 2038 A) was added to the NSWK machine chest as indicated in Table 4.

The HYH was prepared by dispersing about 50 pounds (oven dry basis) HYH pulp in a pulper for 30 minutes at a consistency of about 3 percent. The fiber was then transferred to a machine chest and diluted to a consistency of 1 percent. HYH was produced by processing *H. funifera* using a three stage non-wood pulping process commercially available from Taizen America (Macon, Ga.). The hesperaloe was not refined. The hesperaloe had an average fiber length of about 1.85 mm and a fiber coarseness of about 5.47 mg/100 m.

TABLE 4

| Sample | Furnish Layering | Redibond 2038 A (kg/ton)/Layer | Refining (min) |
|---|---|---|---|
| Control 1 | EHWK/NSWK/EHWK | 3/All | 1 |
| Control 2 | EHWK/NSWK/EHWK | 3/All | 1 |
| Inventive 1 | EHWK/Hesperaloe/EHWK | 0 | — |
| Inventive 2 | EHWK/Hesperaloe/EHWK | 6/EWHK | — |

The stock solutions were pumped to a 3-layer headbox after dilution to 0.75 percent consistency to form a three layered tissue web. EHWK fibers were disposed on the two outer layers and either NSWK or HYH was disposed in the middle layer. The relative weight percentage of the layers was 30%/40%/30%. The formed web was non-compressively dewatered and rush transferred to a transfer fabric traveling at a speed about 28 percent slower than the forming fabric. The transfer vacuum at the transfer to the TAD fabric was maintained at approximately 6 inches of mercury vacuum to control molding to a constant level. The web was then transferred to a T-1205-2 TAD fabric (commercially available from Voith Fabrics, Appleton, Wis. and previously disclosed in U.S. Pat. No. 8,500,955, the contents of which are incorporated herein in a manner consistent with the present disclosure). The web was then dried and wound into a parent roll. The parent rolls were then converted into 1-ply bath tissue rolls. Calendering was done with a steel-on-rubber setup. The rubber roll using in the converting process had a hardness of 40 P&J. The rolls were converted to a diameter of about 117 mm with Kershaw firmness target of about 6 mm and a target roll weight of about 400 grams. Samples were produced as described in Table 5, below.

TABLE 5

| Sample | Basis Weight (gsm) | Target GMT (g/3") | Plies | EHWK (wt %) | NSWK (wt %) | Hesperaloe (wt %) |
|---|---|---|---|---|---|---|
| Control 1 | 31.0 | 650 | 1 | 60 | 40 | — |
| Control 2 | 31.2 | 900 | 1 | 60 | 40 | — |
| Inventive 1 | 31.3 | 650 | 1 | 60 | — | 40 |
| Inventive 2 | 31.9 | 900 | 1 | 60 | — | 40 |

The effect of hesperaloe fibers on various tissue properties, including tensile, durability and softness, is summarized in the tables below.

TABLE 6

| Sample | Basis Weight (gsm) | Sheet Bulk (cc/g) | GMT (g/3") | GM TEA (g · cm/cm$^2$) | GM Slope (kg) | GM Tear (g) | Dry Burst (g) |
|---|---|---|---|---|---|---|---|
| Control 1 | 31.0 | 11.0 | 627 | 5.7 | 4.8 | 8.8 | 588 |
| Control 2 | 31.2 | 12.0 | 883 | 8.6 | 5.4 | 12.9 | 764 |
| Inventive 1 | 31.3 | 11.2 | 635 | 6.0 | 5.2 | 9.5 | 525 |
| Inventive 2 | 31.9 | 11.5 | 920 | 9.7 | 6.2 | 13.3 | 736 |

TABLE 7

| Sample | Tear Index | TEA Index | Burst Index |
|---|---|---|---|
| Control 1 | 14.04 | 9.09 | 9.38 |
| Control 2 | 14.6 | 9.74 | 8.65 |
| Inventive 1 | 14.96 | 9.45 | 8.27 |
| Inventive 2 | 14.46 | 10.54 | 8.00 |

TABLE 8

| Sample | Stiffness Index | Delta Stiffness Index (%) | Durability Index | Delta Durability |
|---|---|---|---|---|
| Control 1 | 7.66 | — | 32.50 | — |
| Control 2 | 6.11 | — | 33.00 | — |
| Inventive 1 | 8.19 | 7 | 32.68 | 1 |
| Inventive 2 | 6.74 | 10 | 33.00 | 0 |

Example 2

Additional single-ply uncreped through-air dried (UC-TAD) tissue web were made generally in accordance with U.S. Pat. No. 5,607,551 at differing basis weights and tensile strengths compared to the tissue products of Example 1. The tissue webs and resulting tissue products were formed from various fiber furnishes including, Eucalyptus Hardwood Kraft (EHWK) pulp, NSWK pulp, and hesperaloe pulp. Fiber furnishes were prepared as described in Example 1 and the following samples were prepared.

TABLE 9

| Sample | Furnish | Redibond 2038 A (kg/ton) | Refining (min) |
|---|---|---|---|
| Control 3 | EHWK/NSWK/EHWK | 0 | — |
| Control 4 | EHWK/NSWK/EHWK | 2 | — |
| Inventive 3 | EHWK/Hesperaloe/EHWK | 4 | — |
| Inventive 4 | EHWK/Hesperaloe/EHWK | 0 | 2 |

The stock solutions were pumped to a 3-layer headbox after dilution to 0.75 percent consistency to form a three layered tissue web. EHWK fibers were disposed on the two outer layers and either NSWK or HYH was disposed in the middle layer. The relative weight percentage of the layers was 30%/40%/30%. The formed web was non-compressively dewatered and rush transferred to a transfer fabric traveling at a speed about 28 percent slower than the forming fabric. The transfer vacuum at the transfer to the TAD fabric was maintained at approximately 6 inches of mercury vacuum to control molding to a constant level. The web was then transferred to a either T-1205-2 or T2407-13 (commercially available from Voith Fabrics, Appleton, Wis. and previously disclosed in U.S. Pat. No. 8,702,905, the contents of which are incorporated herein in a manner consistent with the present disclosure) TAD fabric. The web was then dried and wound into a parent roll. The parent rolls were then converted into 1-ply bath tissue rolls. Calendering was done with a steel-on-rubber setup. The rubber roll using in the converting process had a hardness of 40 P&J. The rolls were converted to a diameter of about 117 mm with Kershaw firmness target of about 6 mm and a target roll weight of about 400 grams. Samples were produced as described in Table 10, below.

TABLE 10

| Sample | Vacuum (Inches of Hg) | TAD Fabric | EHWK (wt %) | NSWK (wt %) | Hesperaloe (wt %) |
|---|---|---|---|---|---|
| Control 3 | 9 | T-1205-2 | 60 | 40 | — |
| Control 4 | 9 | T2407-13 | 60 | 40 | — |
| Inventive 3 | 9 | T-1205-2 | 60 | — | 40 |
| Inventive 4 | 9 | T2407-13 | 60 | — | 40 |

TABLE 11

| Sample | GMT | Basis Weight (gsm) | Bulk (cc/g) | CD Stretch (%) | GM Slope (kg) | Stiffness Index | GM Stretch (%) | GM TEA (g · cm/cm$^2$) | TEA Index |
|---|---|---|---|---|---|---|---|---|---|
| Control 3 | 441 | 26.9 | 15.3 | 8.7 | 4.08 | 9.25 | 11.3 | 4.58 | 10.39 |
| Control 4 | 492 | 27.9 | 15.5 | 8.5 | 4.57 | 9.30 | 11.3 | 4.96 | 10.09 |
| Inventive 3 | 459 | 27.3 | 17.2 | 9.3 | 3.85 | 8.38 | 11.9 | 5.03 | 10.95 |
| Inventive 4 | 460 | 25.8 | 16.6 | 9.5 | 4.21 | 9.16 | 11.7 | 5.06 | 11.01 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a tissue product comprising at least about 20 weight percent high yield hesperaloe pulp fibers, the tissue product having a GMT from about 400 to about 1,000 g/3", a Stiffness Index less than about 10 and a sheet bulk greater than about 10 cc/g.

In a second embodiment the present invention provides the tissue product of the first embodiment having a Burst Index greater than about 8.0.

In a third embodiment the present invention provides the tissue product of the first or the second embodiments having a TEA Index greater than about 8.0.

In a fourth embodiment the present invention provides the tissue product of any one of the first through the third embodiments having a Durability Index greater than about 28.

In a fifth embodiment the present invention provides the tissue product of any one of the first through the fourth embodiments wherein the GM Slope is less than about 6.0 kg.

In a sixth embodiment the present invention provides the tissue product of any one of the first through the fifth embodiments having a GMT from about 700 to about 1,000 g/3 and still more preferably from about 750 to about 900 g/3".

In a seventh embodiment the present invention provides the tissue product of any one of the first through the sixth embodiments wherein the tissue product is substantially free from softwood kraft pulp fibers.

In an eighth embodiment the present invention provides the tissue product of any one of the first through the seventh embodiments comprising from about 25 to about 50 weight percent high yield hesperaloe pulp fibers.

In a ninth embodiment the present invention provides the tissue product of any one of the first through the eighth embodiments wherein the high yield hesperaloe pulp fibers have a lignin content from about 10 to about 15 weight percent.

In a tenth embodiment the present invention provides the tissue product of any one of the first through the ninth embodiments wherein the tissue product is substantially free from NSWK fibers.

In a eleventh embodiment the present invention provides a tissue product comprising at least one multi-layered through-air dried tissue web comprising a first and a second layer, the first layer being substantially free from high yield hesperaloe pulp fibers and the second layer consisting essentially of high yield hesperaloe pulp fibers, the tissue product having a Durability Index greater than about 28.0, such as from about 28.0 to about 32.0 and more preferably from about 29.0 to about 31.0, and a Stiffness Index less than about 10.0.

What is claimed is:

1. A tissue product comprising wood pulp fibers and from about 5 to about 50 weight percent high yield hesperaloe pulp fibers, the product having a geometric mean tensile (GMT) less than about 1000 g/3" and a geometric mean slope (GM Slope) less than about 7.0 kg.

2. The tissue product of claim 1 having a GMT from about 400 to less than about 1,000 g/3".

3. The tissue product of claim 1 having a GMT from about 500 to about 800 g/3".

4. The tissue product of claim 1 having a GM Slope from about 4.5 to about 7.0 kg.

5. The tissue product of claim 1 having a GMT from about 400 to less than about 1,000 g/3" and a GM Slope from about 4.5 to about 7.0 kg.

6. The tissue product of claim 1 having a Stiffness Index from about 7.0 to about 9.0.

7. The tissue product of claim 1 having a Durability Index from about 25 to about 35.

8. The tissue product of claim 1 having a GMT from about 400 to less than about 1,000 g/3", a Durability Index from about 30 to about 35 and a Stiffness Index from about 8.0 to about 10.0.

9. The tissue product of claim 8 having a GM Slope from about 4.5 to about 7.0 kg.

10. The tissue product of claim 1 comprising less than about 5 weight percent Northern softwood kraft (NSWK) and from about 10 to about 40 weight percent high yield hesperaloe fiber.

11. The tissue product of claim 1 comprising at least one multi-layered through-air dried web wherein the high yield hesperaloe fiber is selectively disposed in only one layer of the multi-layered through-air dried web.

12. The tissue product of claim 1 having a Burst Index greater than about 8.0.

13. The tissue product of claim 1 having a TEA Index greater than about 9.0.

14. The tissue product of claim 1 having a Tear Index greater than about 12.0.

15. The tissue product of claim 1 having a basis weight from about 30 to about 60 grams per square meter (gsm).

* * * * *